US006681661B2

(12) United States Patent
Lalonde

(10) Patent No.: US 6,681,661 B2
(45) Date of Patent: Jan. 27, 2004

(54) DETACHABLE AND ADJUSTABLE SOUND AND FEEDBACK CONTROL DEVICE FOR STRINGED MUSICAL INSTRUMENTS HAVING A HOLLOW BODY WITH A SOUND HOLE

(76) Inventor: Anthony F. Lalonde, P.O. Box H, San Jose, CA (US) 95151

( * ) Notice: Subject to any disclaimer, the term of this patent is extended or adjusted under 35 U.S.C. 154(b) by 0 days.

(21) Appl. No.: 10/091,436

(22) Filed: Mar. 5, 2002

(65) Prior Publication Data

US 2003/0167901 A1 Sep. 11, 2003

(51) Int. Cl.[7] ..... G10D 1/08
(52) U.S. Cl. ..... 81/267; 84/290; 84/267
(58) Field of Search ..... 84/267, 290, 291, 84/294

(56) References Cited

U.S. PATENT DOCUMENTS 4,632,003 A * 12/1986 Kopp ..... 84/723

* cited by examiner

*Primary Examiner*—Kimberly Lockett
(74) *Attorney, Agent, or Firm*—John J. Leavitt

(57) ABSTRACT

Presented is a detachable and adjustable cover member for the sound hole of a string instrument such as a guitar. The cover member provides a base member to which are attached elastically resilient keeper blocks that detachably engage the periphery of the sound hole. The base member is apertured to admit sound into the hollow body of the string instrument and to enable feedback of such sound when the apertures are open to the atmosphere. An adjustable sound and feedback control dial is a detachably mounted on the top surface of the base member and is provided with apertures corresponding in size and configuration with the apertures in the base member. The control dial may be selectively digitally adjusted to place the apertures in the dial in registry with the apertures in the base member to enable the ingress and egress of sound therethrough or adjusted to partially or totally occlude the passage of sound through the sound hole. The cover member also provides a platform for the suspension of a humidifier assembly within the hollow body on which the sound hole cover member is detachably mounted.

12 Claims, 4 Drawing Sheets

(OPEN)

(CLOSED)

(CLOSED)

(OPEN)

(OPEN)

(CLOSED)

(OPEN)

(CLOSED)

DETACHABLE AND ADJUSTABLE SOUND AND FEEDBACK CONTROL DEVICE FOR STRINGED MUSICAL INSTRUMENTS HAVING A HOLLOW BODY WITH A SOUND HOLE

BACKGROUND OF THE INVENTION

1. Field of the Invention

This invention a relates to musical instruments having a hollow body including an opening or hole for sound to escape from the hollow body and a fret board provided with strings that extend across the sound hole, and particularly to a detachable and adjustable sound feedback control device mounted on the instrument in cooperative association with the sound hole and adjustable to control the decibel level of the musical sound notes that emanate from the sound hole.

2. Description of the Prior Art

Prior art pertinent to this invention includes U.S. Pat. Nos. 3,636,809; 4,024,788; 4,394,830 and 4,632,003.

U.S. Pat. No. 3,636,809 discloses dual opposingly positioned sound holes incorporating a sound hole cover device capable of generating a variety of tonal colors ranging from a selection of total occlusion to zero occlusion or full opening thereof.

U.S. Pat. No. 4,024,788 discloses a sound hole cover muting device for a guitar whereby the muting of the guitar is accomplished with a fully occlusive sound hole cover provided with a downward projecting resilient member that extends through the sound hole.

U.S. Pat. No. 4,394,830 discloses a sound hole cover feedback reducer for acoustic and electric guitars, and in particular, as shown in FIG. 5 of that patent, the sound hole cover member is integrally provided with a plurality of resilient finger members shaped with so-called "inclined detent cam surfaces" operable for effecting cover retention by deforming radially inward during sound hole insertable installation and returning to the un-deformed retention attitude once insertable cover affixation has been accomplished and thereby collectively functioning to hold the cover in place.

U.S. Pat. No. 4,632,003 discloses a variety of devices adapted to be mounted in the sound hole of a stringed instrument and having on its peripheral underside a cushioning gasket and a plurality of integral circumferentially spaced downwardly and radially outwardly projecting fingers adapted to slip under the associated peripheral edge portion of the sound hole to retain the device in operable association with the sound hole.

The instant invention, however, provides new and useful structural and functional features in the art of stringed musical instrument sound quality enhancement and control devices by a combination of elements not taught by the prior art, resulting in the present device embodying construction features of novel merit as set forth hereinafter.

One of the principal objects of the present invention is the provision of a detachable and adjustable cover member for the sound hole of a stringed musical instrument having a hollow body and a generally circular hole or aperture through which sound normally emanates when the instrument is played and the hole is open or non-occluded.

Another object of the invention is the provision of a detachable and adjustable sound hole cover device that may be selectively applied to sound holes of different diameters ranging from 3¼" to 4".

Still another object of the invention is the provision of a detachable and adjustable sound hole cover device that may be applied to help elimination of feedback in electric acoustic instruments, such as guitars, and to adjustably control sound emanating from the sound hole in conventional non-acoustic stringed instruments.

Another object of the invention is the provision of a sound and feedback control device that includes a generally circular base plate detachably mounted in overlapping association with the a peripheral portion of the sound hole or aperture in the musical instrument and having formed therein independent openings that communicate with the interior of the hollow body, with a second element constituting a rotatable plate having occlusive areas corresponding with the independent openings in the base plate and pivotally mounted on the base plate and for digital manipulation to selectively either cover or uncover the independent openings formed in the base plate.

A still further object of the invention is the provision of an occlusivally adjustable and detachably mountable cover member for the sound hole of a stringed instrument that is easy to install and remove, which fits snugly and sealingly over the sound hole and which includes an adjustable apertured dial enabling selection of the desired opening or closing of the sound hole.

Yet another object of the invention is the provision of an occlusivaly adjustable and detachably mounted cover member for the sound hole of a stringed instrument wherein the surface of the base member facing into the sound hole is provided with a layer of acoustic absorbing material and the confronting surface of the adjustable apertured dial pivotally mounted on the base member is also provided with a layer of acoustic absorbent material.

A still further object of the invention is the provision of an occlusivaly adjustable and detachably mountable cover member for the sound hole of a stringed instrument, such as a guitar, wherein the cover member is provided with a latterly extending plate portion on the surface of which are provided pockets for removably retaining guitar picks or other devices.

Yet another object of the invention is a sound hole cover device as illustrated and described to which may be detachably secured a humidifier assembly for controlling the humidity within the hollow musical instrument.

The invention possesses other objects and features of advantage, some of which, with the foregoing, will be apparent from the following description and the drawings. It is to be understood however that the invention is not limited to the embodiments illustrated and described since it may be embodied in various forms within the scope of the appended claims.

SUMMARY OF THE INVENTION

In terms of broad inclusion the invention comprises a detachably mountable and occlusivally adjustable cover member for the sound hole of a string instrument, such as a guitar, to enable complete closure of the hole or digitally adjustable to provide varying degrees of opening of the sound hole. The cover member incorporates a flat base plate having a top surface and a bottom surface configured circularly about a central axis. The flat base plate is circularly configured about the central axis to overlap a circular peripheral edge portion of the sound hole and may also be provided with chordal projections adapted to embrace the associated end of a fingerboard. Alternatively, an arcuate portion of the base plate may be cut away to provide a chordal edge adapted to abut the associated end of a fingerboard, sometimes referred to as "fretboard". The base plate is provided with two generally triangular openings the apices of which are coincident along a common plane that is diametrically offset from the central axis and lie on opposite sides of a pivotal axis that is coincident with the common plane that is diametrically offset from the central axis. Pivotally mounted on the base plate on the pivotal axis that is offset from the central axis is a circular adjustment plate or dial of less diameter than the base plate and circularly symmetrical about the pivotal axis. Formed in the circular adjustment or dial plate diametrically on opposite sides of the pivotal axis are a pair of generally triangular openings of substantially the same size and configuration of the generally triangular openings in the base plate. Means are provided on the outer peripheral edge of the rotatable adjustment plate to digitally effect selective rotation of the adjustment plate in relation to the base plate. When the generally triangular openings in the adjustment plate are circumferentially displaced so as to coincide with the openings in the base plate, the coincident openings uncover a specific area of the sound hole. From this position of the rotatable adjustment plate, the adjustment plate may be rotated clockwise or counterclockwise to progressively diminish the open area of the sound hole until it is totally occluded. Means are provided on the underside of the base plate and the adjustment dial plate to acoustically absorb sound emanating from the sound hole and to provide a seal between the base plate and the instrument body and between the adjustment plate and the associated surface of the base plate. In another aspect of the invention a humidity control device may be mounted on the underside of the cover plate assembly for protrusion within the hollow instrument body to maintain a desirable humidity within the instrument body despite the outside atmospheric humidity.

DETAILED DESCRIPTION OF THE INVENTION

Figure 1:
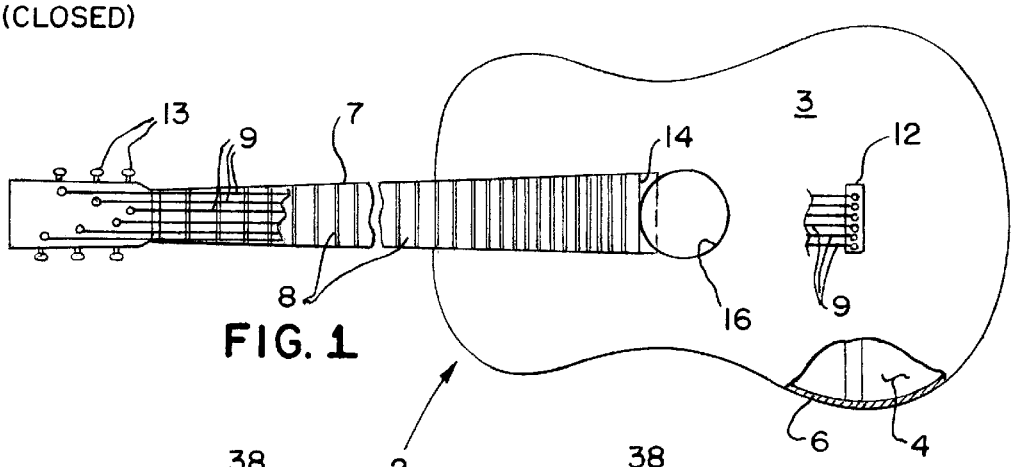
FIG. 1 is a plan view of a representative musical instrument (guitar) illustrating the sound hole formed in the top surface of the hollow body in conjunction with which the invention hereof is utilized.

In terms of greater detail and referring first to FIG. 1, it will there be seen that a musical instrument in the form of a guitar is shown for illustrative purposes. The guitar has a hollow body designated generally by the numeral 2 including a top wall 3, a bottom wall 4 and edge or sidewalls 6. The guitar is also provided with a fingerboard designated generally by the numeral 7, which is in turn provided with the customary frets 8 over which extend the tensioned guitar strings 9 each anchored at its proximate end to an anchor block 12 and at its opposite distal end attached to a rotatable string tension adjustment thumbscrew 13. The proximate end of 14 of the fingerboard is frequently positioned adjacent the periphery of a sound hold 16 but in some instances projects slightly over the hole 16 as indicated by the broken lines in FIG. 1.

Figure 4:
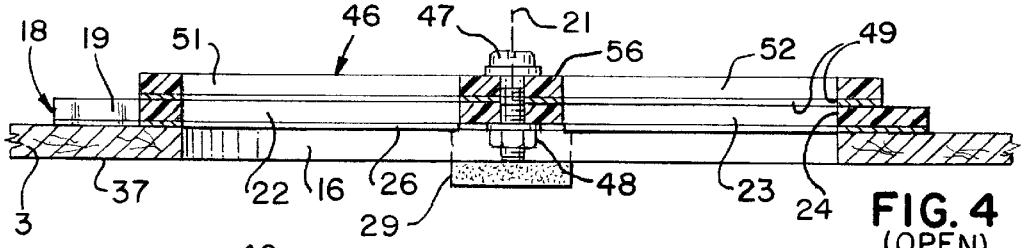
FIG. 4 is a vertical cross-sectional view taken in the plane indicated by the line 4—4 in FIG. 2.
Figure 5:
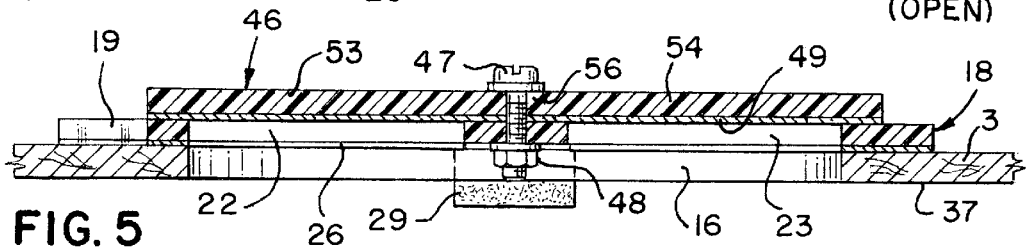
FIG. 5 is a vertical cross-sectional view taken in the plane indicated by the line 5—5 in FIG. 3.

In either case, the detachable and adjustable sound and feedback control device of the invention designated in a first embodiment generally by the numeral 17 in FIGS. 2, 3, 4, 5, 6 and 7 accommodates the proximate end 14 of the fingerboard as will hereinafter be explained. Referring to FIGS. 2, 3, 4, 5, 6 and 7, this first preferred embodiment of the sound control device of the invention includes a generally flat base member designated generally by the numeral 18 and conveniently fabricated from an appropriate synthetic resinous material such as polypropylene. The base member is formed with a sound hole cover portion 19 having a generally asymmetrical outer peripheral configuration formed about a pivotal axis 21 and is provided with two opposing generally triangular openings 22 and 23 the apices of which lie adjacent to but spaced on opposite sides of the pivotal axis 21. Each opening 22 and 23 is formed by radially extending side edges that diverge from one another at approximately 90° to be intercepted by a circular edge 24 that coincides with the inner periphery of the sound hole 16 and which constitutes the inner periphery of the sound hole cover portion 19 the outer periphery of which overlaps the top surface 3 beyond the inner periphery of the sound hole by an appropriate amount, say about a quarter inch, as illustrated in FIGS. 4 and 5.

Adhesively secured to the underside of the base portion is a thin layer 26 of soft cushioning material, such as closed-cell polyurethane, having a thickness of about 1/16th of an inch. This cushioning material may cover the entire undersurface of the cover portion 19 or may be adhesively secured in a triangular pattern on the opposed triangular portions 27 and 28 of the cover portion 19, the apices of which opposed triangular portions lie adjacent the pivotal axis 21. When the flat base member 18 is placed on the upper surface of the top wall 3 superimposed over the sound hole16, the soft cushioning material abuts the upper surface of the top wall and prevents the supporting top surface from being marred. Additionally, the layer 26 of soft cushioning material is slip-resistant in relation to the top surface of the top wall and assists in retaining the cover portion in position in relation to the underlying sound hole 16.

To ensure that the sound hole cover portion is securely retained in superposed relation over the sound hole, diametrically opposed elastically resilient elongated keeper blocks 29 and 31 are adhesively secured to the underside of the cover portion 19 by corresponding end portions 32 and 33 while the opposite end portions 34 and 36 of the diametrically opposed keeper blocks are not secured and are free to be elastically and resiliently flexed downwardly through the sound hole inner periphery whereupon, because of their elasticity and resilience, the keeper blocks flex upwardly to engage the underside 37 of the top wall 3, thus securely retaining the cover portion superimposed over the sound hole.

In the first embodiment of the invention illustrated in FIGS. 2, 3, 4, 5, 6 and 7, the base member 18 is extended laterally away from the pivotal axis in a flat portion 38 having a top surface 39 on which are secured side-by-side a pair of triangular pockets 41 and 42 each having an open end in which may be stored one or more triangular picks 43, useful by the guitar player to pluck the strings of the guitar.

Figure 10:
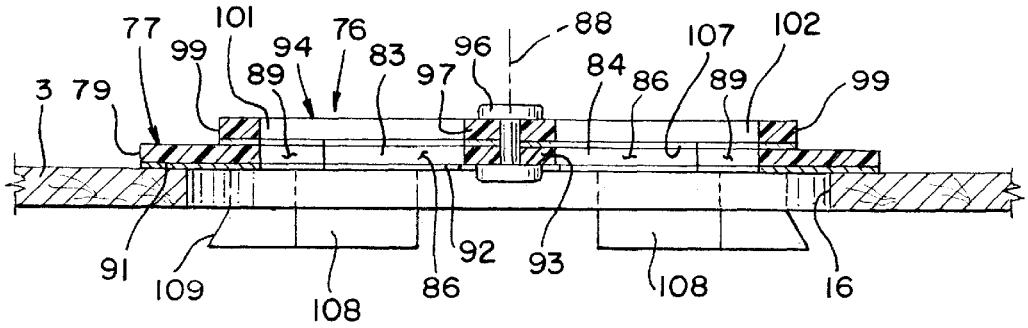
FIG. 10 is a vertical cross-sectional view taken in the plane indicated by the line 10—10 in FIG. 8 and illustrating the sound hole open.

Rotatably mounted on the flat base member 18 for adjustable rotation about the pivotal axis 21 is a flat generally circular dial designated generally by the numeral 46. The dial is pivotally secured to the base member 18 by an appropriate bolt 47 the threaded shank of which passes through the central portion of the base member and the central portion of the dial along the pivotal axes 21. A nut 48 is threaded onto the threaded end portion of the shank as shown in FIG. 10 to retain the base member and dial rotatably oriented one with the other. It will of course be understood that instead of a bolt and nut assembly an appropriate rivet may be substituted to retain the base member and dial in a rotatable confronting relation. Additionally, there is adhesively adhered to the underside of the dial a thin layer 49 of cushioning material similar to the cushioning later 26 adhered to the underside of the base member 18.

Figure 2:
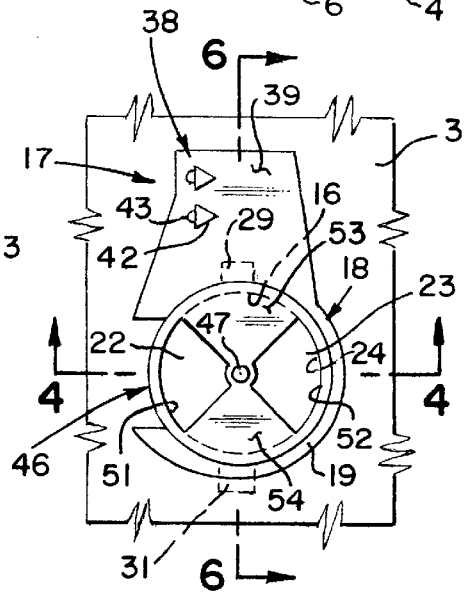
FIG. 2 is a fragmentary plan view illustrating a first preferred embodiment of the invention mounted on the top surface of the instrument in operative association with the sound hole with a specific area of the sound hole open.

While the dial 46 is preferably circular and symmetrical about the pivotal axis it may of course be asymmetrical provided it is configured to overlap the top surface of the base member surrounding the sound hole 16 by a sufficient amount to selectively cover or uncover the triangular openings 22 and 23 formed in the base member. To achieve this end, the dial 46 is provided with two diametrically opposed generally triangular apertures or openings 51 and 52 the apices of which are adjacent the pivotal access 21 but on opposite sides thereof. The openings 51 and 52 correspond in size and configuration with the openings 22 and 23 formed in the base member. Thus, as shown in FIGS. 2 and 4, the dial may selectively be rotated to place the openings in the dial opposite the openings in the base member, thus uncovering or opening a specific area of the sound hole for sound to enter and emanate there-from when the guitar strings are plucked.

Figure 3:
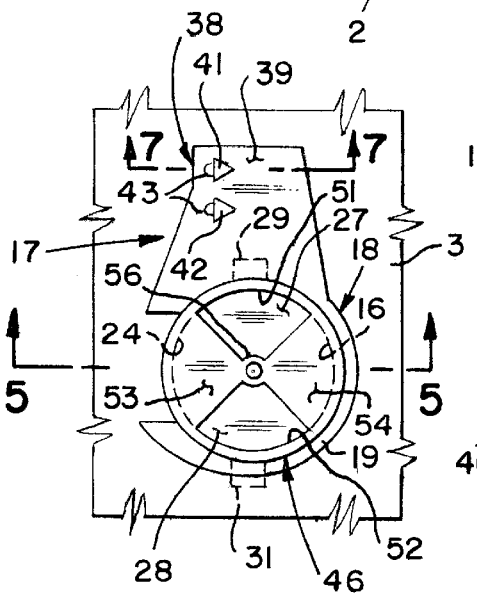
FIG. 3 is a fragmentary plan view similar to FIG. 2 but illustrating the sound control device adjusted to sound hole closed orientation.

Conversely, as shown in FIGS. 3 and 5, the dial may be pivoted so as to place the openings 51 and 52 over the triangular portions 27 and 28 of the base member and thus completely close the sound hole to prevent the entry of sound through the sound hole and into the hollow interior of the body 2 when the guitar strings are plucked. It should be noted that when the triangular openings 51 and 52 are formed in the dial 46, the remaining triangular portions 53 and 54 (FIG. 5) of the dial, being of about the same size and configuration as the openings 22 and 23 (FIG. 5) in the base member, cover the openings in the base member, thus preventing the entry of sound into the sound hole. Additionally, it should be noted that the triangular portions 53 and 54 (FIG. 5) converge toward their apices to form the central dial portion 56 of the dial through which the bolt 47 is inserted. To apply the sound hole cover device to the top wall of the instrument the device is tipped slightly and displaced downwardly (FIG. 2) to engage the end portion 34 of the keeper block 31 with a peripheral edge portion of the top wall defining the periphery of the sound hole. Continued displacement causes the keeper block 29 to project through the sound hole, whereupon the elastic and resilient upward displacement of the free end of the keeper block causes the free end 36 of the keeper block 29 to engage under the peripheral edge portion of the top wall that surrounds the sound hole. The device is now centered in relation to the sound hole and detachably secured to the top wall by the elastic and resilient keeper blocks 29 and 31. The dial may now be adjusted to whatever position is selected by the player ranging from fully open to fully closed and any intermediate position desired by the player.

Figure 6:
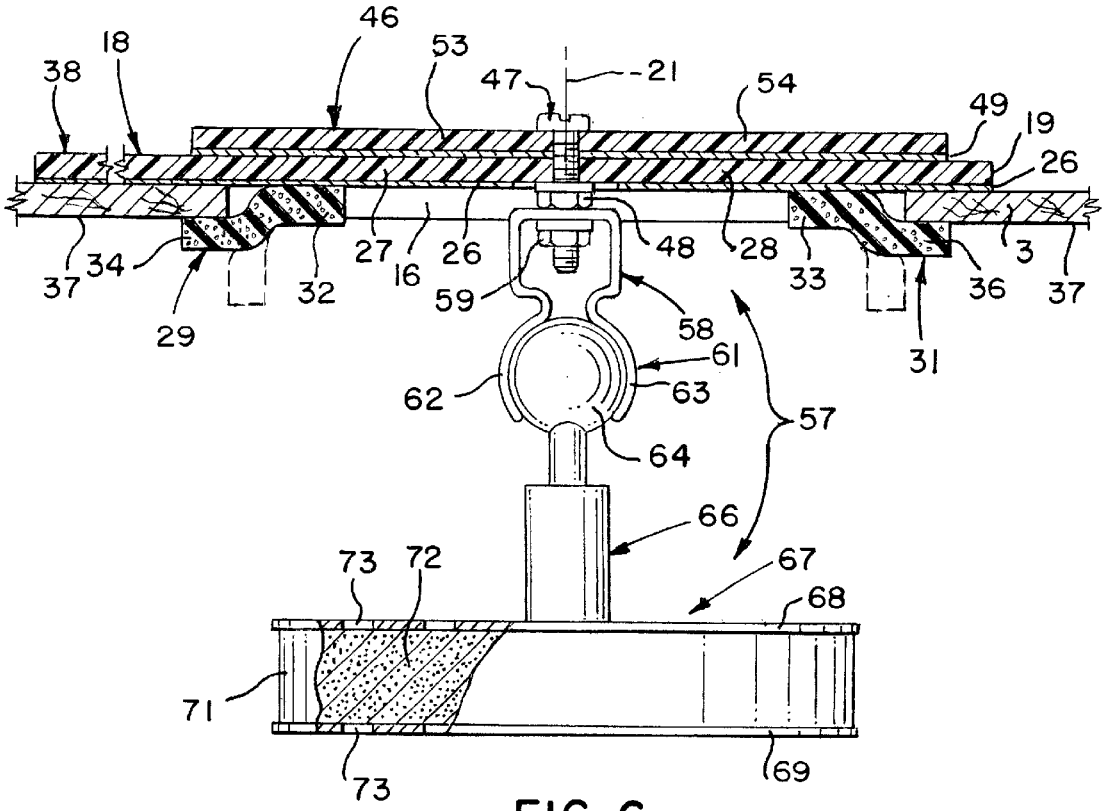
FIG. 6 is a fragmentary vertical cross-sectional view taken in the plane indicated by the line 6—6 in FIG. 2.
Figure 7:
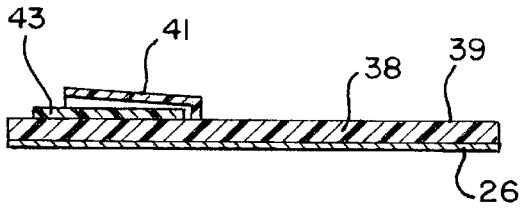
FIG. 7 is a fragmentary vertical cross-sectional view taken in the plane indicated by the line 7—7 in FIG. 3 and illustrating a pocket in which guitar picks may be stored.

Referring to FIG. 6, it will be seen that a humidifier assembly designated generally by the numeral 57 has been detachably suspended from the lower end of the bolt 47. The humidifier assembly includes a clamp member 58 detachably secured to the bolt 47 by a nut 59. The lower end portion 61 of the clamp member is formed to provide two opposed resilient arcuate cup portions 62 and 63 spaced apart at their lower ends to unable a spherical ball 64 to be cammed between the arcuate portions, spreading them apart, and inserted there-between until the ball is cupped between the two resilient arcuate portions as seen in FIG. 6. The ball is attached to a stem 66 which is in turn attached to the center of a cylindrical shell 67 suitably formed by top and bottom plates 68 and 69, respectively, joined by a cylindrical band 71 to form a hollow interior within which is packed a suitable mass 72 of water absorbent material such as open-cell polyurethane foam which when immersed in water absorbs and holds the water against leakage. Suitable holes 73 are formed in the top and bottom plates to admit air into the shell to effect evaporation of moisture from the mass 72 to thus humidify the interior of the body 2. The size and number of the holes and the humidity outside the body will determine the rapidity and extent of the evaporation of moisture within the body 2. The holes 73 are shown greatly enlarged in the interest of clarity in the drawings. In general, the holes will be microscopic in size and a large number are provided to enhance evaporation of the moisture and humidification of the walls of the musical instrument body.

Figure 8:
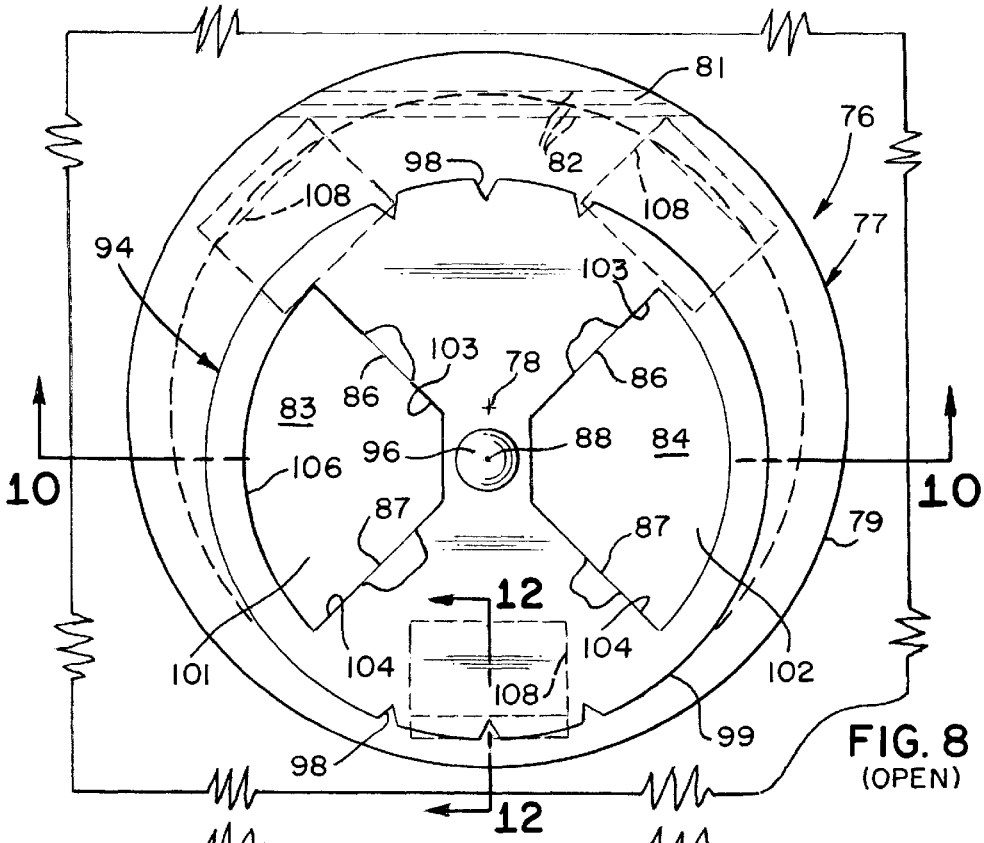
FIG. 8 is a plan view illustrating a second preferred embodiment of the invention mounted on the top surface of the instrument in operative association with the sound hole with a significant portion of the sound hole open.
Figure 9:
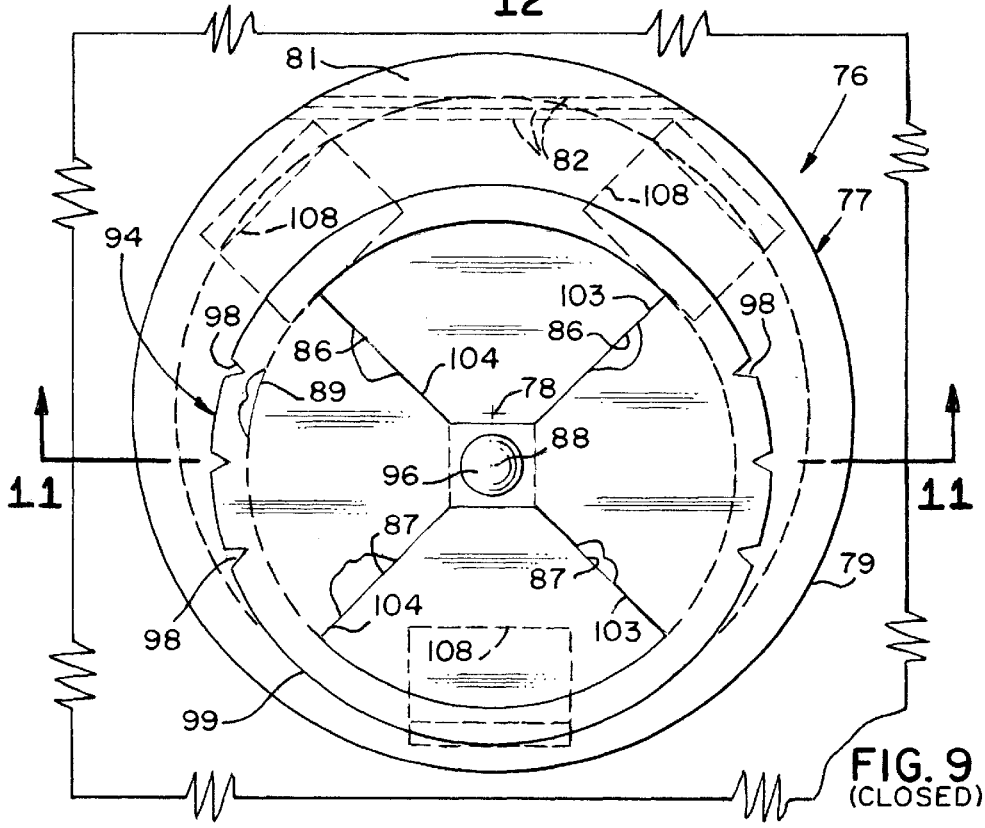
FIG. 9 is a plan view similar to FIG. 8 but illustrating the cover member adjusted to closed condition to achieve full occlusion of the sound hole.

Referring now to the second preferred embodiment of the detachable and adjustable sound hole cover of the invention as illustrated in FIGS. 8, 9, 10, 11 and 12, it will be seen that this second embodiment of the sound hole cover is substantially similar to the first embodiment and is designated generally by the numeral 76. This second embodiment SUCH includes a base member 77 formed preferably from a suitable synthetic resinous material such as polypropylene but which may also be fabricated from other suitable materials such as plastic impregnated or plastic coated cardboard. The base member 77 as illustrated is formed about an axis 78 to provide a major circular outer peripheral portion 79 that is symmetrical about the axis 78. When necessary to accommodate the end 14 of the fingerboard 7 when the sound hole cover member 76 is detachably mounted over the sound hole 16, a sector 81 of the base member may be broken or cut away from the main body of the base member along any one of the several score lines 82 formed on the underside of the base member as shown in FIGS. 8 and 9.

Figure 11:
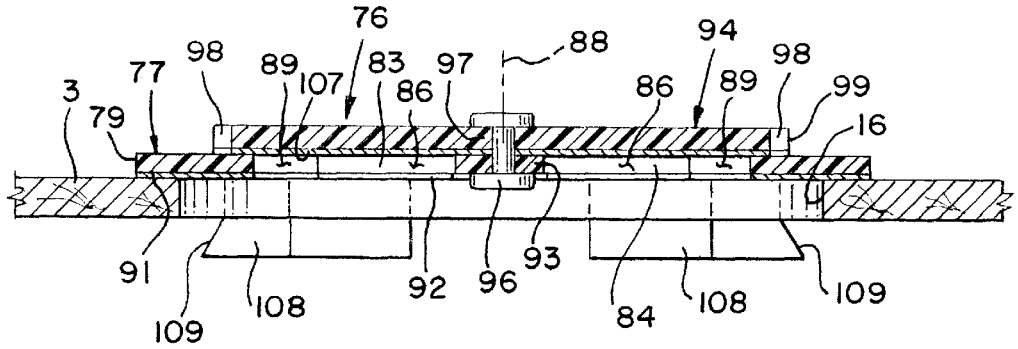
FIG. 11 is a vertical cross-sectional view taken in the plane indicated by the line 11—11 in FIG. 9 and showing the sound hole closed.

The base member 77 is also provided with two diametrically opposed generally triangular openings 83 and 84 each of which is formed by side edges 86 and 87 that diverge at a 90° angle from adjacent a rotational axis 88 spaced from the axis 78 and which are intercepted by a circularly arcuate edge 89 spaced radially inwardly from the outer periphery 79 of the base member so that the arcuate edge 89 coincides with the periphery of the sound hole 76. Adhesively secured to the underside 91 of the base member 77 is a cushioning layer 92 of closed-cell polyurethane foam or similar material that functions to provide a slip-resistant engagement of the cover member on the top wall 3 of the instrument body. As seen in FIGS. 10 and 11, the openings 83 and 84 diverge radially outward from a central mounting portion 93. Because the openings 83 and 84 are oppositely positioned diametrically from one another and because the side edges 86 and 87 diverge from the central mounting portion 93 at 90°, it will be understood that the arcuate edge 89 of each opening 83 and 84 subtend an arc of 90° spaced about 1½ inches from the axis 88 so that together the two openings equate with approximately 37.5% of the area of the sound hole 16. Stated in other terms, if the sound hole is 4" in diameter (12.57 square inches) the two openings 83 and 84 constitute approximately 4.71 square inches, resulting in 7.65 square inches of the sound hole being occluded when the base member is detachably mounted on the top wall of the instrument.

To effect a complete occlusion of the sound hole, or to effect occlusion of a selected percentage of the 37.5% of the sound hole that is normally open when the base member is detachably superimposed over the sound hole, there is provided a dial 94 rotatably mounted on the base member by rivet 96 passing through the mounting portion 97 of the dial and the mounting portion 93 of the base member and freely rotatable by digital manipulation utilizing the notches 98 formed in the outer periphery 99 of the dial 94. The dial is provided with two diametrically opposed triangular openings 101 and 102 that diverge from opposite sides of the rotational axis 88, each opening having side edges of 103 and 104 diverging from the axis of rotation at an angle of 90° and being intercepted by a circularly arcuate edge 106 which lies about 1½' from the rotational axis 88. Thus, referring to FIGS. 8 and 9, it will be seen that in FIG. 8 the openings 101 and 102 in the dial coincide with the triangular openings 83 and 84 in the base member, thus enabling sound to enter the guitar body and to emanate therefrom. In contrast, referring to FIG. 9, it will be seen that the dial has been rotated through 90°, thus effecting total occlusion of the openings 83 and 84 in the base member and preventing the ingress or egress of sound from the guitar body. A layer 107 of cushioning material is adhesively secured to the underside of the rotatable dial to provide a slight frictional force between the dial and the underlying base member to retain the dial in its adjusted position.

Figure 12:
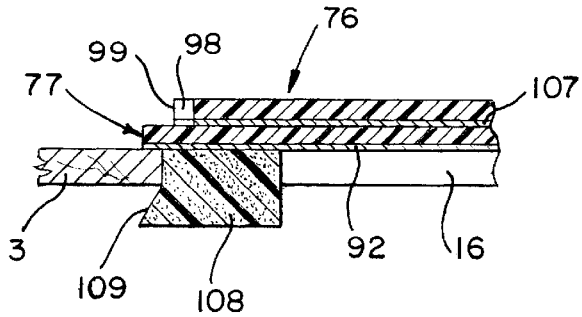
FIG. 12 is a fragmentary vertical cross-sectional view taken in the plane indicated by the line 12—12 in FIG. 8.

To retain the sound hole cover member 76 detachably secured to the top wall 3 of the guitar or other instrument, three elastically resilient keeper blocks 108 conveniently formed of closed-cell polyurethane foam adhesively secured to the underside of the base member in circumferentially spaced locations as shown in FIGS. 8 and 9, where two of the keeper blocks are circumferentially spaced about 90° apart while the remaining third keeper block is circumferentially spaced about 135° from the other two keeper blocks. While three such keeper blocks are shown in the drawings, it should be understood that two keeper blocks placed diametrically 180° apart as in FIGS. 2 and 6 would adequately retain the sound hole cover member detachably secured to the top wall 3 in operative association with the sound hole 16. To facilitate insertion and retention of the elastically resilient keeper blocks 108 on the peripheral portion of the sound holes 16, each keeper block is beveled along one edge 109 as illustrated in FIG. 12.

It will thus be seen that all that is necessary to detachably install the sound hole cover member of this second embodiment is to superimpose the unit over the sound hole 16, press downwardly lightly on the base member at the aproximate locations of the keeper blocks so as to compress the beveled edges of the keeper blocks until the beveled edges penetrate the sound hole. The elastic resilience of the keeper blocks will then detachably retain the sound hole cover member in its mounted position. To remove the cover member, all that is required is that an upward force be imposed on the base member which may most easily be done by adjusting the dial to "open" position as shown in FIG. 8, inserting one or two fingers through the openings 51/22 (FIG. 4) or 101/83 (FIG. 10) and impose an upward force on the base member to disengage the keeper blocks from the periphery of the sound hole to release the cover member for removal.

Having thus described the invention, what is believed to be new novel and sought to be protected by letters patent of United States is as defined in the appended claims.

I claim:

1. A detachable and adjustable sound and feedback control device for a stringed musical instrument having a hollow body including a top wall having a sound hole for the ingress and egress of musical sounds produced by the string instrument when the strings are plucked, said control device comprising:

a) a base member having a top surface and a bottom surface and having at least two diametrically opposed generally triangular openings penetrating said top and bottom surfaces for the passage of musical sound and adapted to be superimposed over said sound hole in said top wall under the strings of said musical instrument whereby said sound hole and said at least two diametrically opposed openings in said base member are normally in communication for the passage of musical sounds therethrough when the strings are plucked;

b) means mounted on said base member selectively detachably engageable to said top wall to retain said sound and feedback control device operatively associated with said sound hole; and c) a dial rotatably mounted on said base member adjacent said top surface of said base member about a rotational axis and having at least two diametrically opposed openings therein, said dial being selectively rotatably adjustable to place said at least two diametrically opposed openings in superposed sound communicating relationship with said at least two diametrically opposed openings in said base member or to occlude said at least two diametrically opposed openings in said base member.

2. The sound and feedback control device according to claim 1, wherein said base member includes a pivotal axis and is provided with at least two openings diametrically opposed on opposite sides of said pivotal axis.

3. The sound and feedback control device according to claim 1, wherein said base member includes a main body portion having an outer periphery sufficient to overlap the peripheral edge portion of said sound hole and inner peripheral portions coinciding with peripheral portions of said sound hole.

4. The sound and feedback control device according to claim 2, wherein said dial rotatably mounted on said base member is circular in configuration about said pivotal axis and is provided with two openings therein on opposite sides of said pivotal axis, said pivotal axis being laterally offset from the geometric center of said base member.

5. The sound and feedback control device according to claim 1, wherein said dial rotatably mounted on said base member is provided with a circular outer periphery, and said circular outer periphery is provided with at least one notch to facilitate selective digital rotation of said dial.

6. A detachable and adjustable sound and feedback control device for a stringed musical instrument having a hollow body including a top wall having a sound hole for the ingress and egress of musical sounds produced by the string instrument when the strings are plucked, said control device comprising:

a) a base member having a top surface and a bottom surface and having at least one opening penetrating said top and bottom surfaces for the passage of musical sound and adapted to be superimposed over said sound hole in said top wall under the strings of said musical instmment whereby said sound hole and said opening in said base member are normally in communication for the passage of musical sounds therethrough when the strings are plucked;

b) means mounted on said base member selectively detachably engageable to said top wall to retain said sound and feedback control device operatively associated with said sound hole;

c) a dial rotatably mounted on said base member adjacent said top surface of said base member and having at least one opening therein, said dial being selectively rotatably adjustable to place said at least one dial opening in superposed sound communicating relationship with said at least one opening in said base member or to occlude said at least one opening in said base member; and d) wherein said base member is provided with a latterly extending portion disposed on said top wall spaced from said sound hole, and pockets are provided on said latterly extending for the reception of one or more guitar picks.

7. A detachable and adjustable sound and feedback control device for a stringed musical instrument having a hollow body including a top wall having a sound hole for the ingress and egress of musical sounds produced by the string instrument when the strings are plucked, said control device comprising:

a) a base member having a top surface and a bottom surface and having at least one opening penetrating said top and bottom surfaces for the passage of musical sound and adapted to be superimposed over said sound hole in said top wall under the strings of said musical instrument whereby said sound hole and said opening in said base member are normally in communication for the passage of musical sounds therethrough when the strings are plucked;

b) means mounted on said base member selectively detachably engageable to said top wall to retain said sound and feedback control device operatively associated with said sound hole;

c) a dial rotatably mounted on said base member adjacent said top surface of said base member and having at least one opening therein, said dial being selectively rotatably adjustable to place said at least one dial opening in superposed sound communicating relationship with said at least one opening in said base member or to occlude said at least one opening in said base member;

d) wherein said base member includes a pivotal axis and is provided with two openings on opposite sides of said pivotal axis; and e) wherein said two openings are generally triangular in configuration with the apices of the triangular openings being adjacent said pivotal axis and the sides of said openings opposite the apices being arcuate and coincident with the periphery of said sound hole.

8. A detachable and adjustable sound and feedback control device for a stringed musical instrument having a hollow body including a top wall having a sound hole for the ingress and egress of musical sounds produced by the string instrument when the strings are plucked, said control device comprising:

a) a base member having a top surface and a bottom surface and having at least one opening penetrating said top and bottom surfaces for the passage of musical sound and adapted to be superimposed over said sound hole in said top wall under the strings of said musical instrument whereby said sound hole and said opening in said base member are normally in communication for the passage of musical sounds therethrough when the strings are plucked;

b) means mounted on said base member selectively detachably engageable to said top wall to retain said sound and feedback control device operatively associated with said sound hole;

c) a dial rotatably mounted on said base member adjacent said top surface of said base member and having at least one opening therein, said dial being selectively roratably adjustable to place said at least one dial opening in superposed sound communicating relationship with said at least one opening in said base member or to occlude said at least one opening in said base member; and d) wherein said means mounted on said base member detachably engageable to said top wall to retain said sound and feedback control device operatively associated with said sound hole comprises at least two elastically resilient and compressible keeper blocks spaced circumferentially on the underside of said base member and compressible through said sound hole to impinge an the periphery thereof to detachably retain said sound and feedback control device superimposed over said sound hole.

9. The sound control device according to claim 7, wherein said dial rotatably mounted on said base member is circular in configuration about said pivotal axis and is provided with two diametrically opposed openings triangular in configuration with the apices of the triangular openings being adjacent said pivotal axis and the sides of said openings adjacent to and opposite said apices being selectively coincident with the triangular openings in said base member whereby sound may pass into and out of said hollow body through said sound hole.

10. The sound control device according to claim 7, wherein said dial rotatably mounted on said base member is circular in configuration about said pivotal axis and is provided with two diametrically opposed openings triangular in configuration with the apices of the triangular openings being adjacent said pivotal axis and said openings in said dial being selectively offset 90° from the openings in said base member whereby said sound hole is occluded to the passage of sound.

11. A detachable and adjustable sound and feedback control device for a stringed musical instrument having a hollow body including a top wall having a sound hole for the ingress and egress of musical sounds produced by the string instrument when the strings are plucked, said control device comprising:

a) a base member having a top surface and a bottom surface and having at least one opening penetrating said top and bottom surfaces for the passage of musical sound and adapted to be superimposed over said sound hole in said top wall under the strings of said musical instrument whereby said sound hole and said opening in said base member are normally in communication for the passage of musical sounds therethrough when the strings are plucked;

b) means mounted on said base member selectively detachably engageable to said top wall to retain said sound and feedback control device operatively associated wit said sound hole;

c) a dial rotatably mounted on said base member adjacent said top surface of said base member and having at least one opening therein, said dial being selectively rotatably adjustable to place said at least one dial opening in superposed sound communicating relationship with said at least one opening in said base member or to occlude said at least one opening in said base member; and d) wherein a layer of cushioning material is secured to the bottom surface of said base member so as to be interposed between said base member and said top wall of said musical instrument when said control device is mounted in said sound hole.

12. A detachable and adjustable sound and feedback control device for a stringed musical instrument having a hollow body including a top wall having a sound hole for the ingress and egress of musical sounds produced by the string instmment when the strings are plucked, said control device comprising:

a) a base member having a top surface and a bottom surface and having at least one opening penetrating said top and bottom surfaces for the passage of musical sound and adapted to be superimposed over said sound hole in said top wall under the strings of said musical instrument whereby said sound hole and said opening in said base member are normally in communication for the passage of musical sounds therethrough when the strings are plucked;

b) means mounted on said base member selectively detachably engageable to said top wall to retain said sound and feedback control device operatively associated with said sound hole;

c) a dial rotatably mounted on said base member adjacent said top surface of said base member and having at least one opening therein, said dial being selectively rotatably adjustable to place said at least one dial opening in superposed sound communicating relationship with said at least one opening in said base member or to occlude said at least one opening in said base member; and d) wherein said dial is provided with a top surface and a bottom surface, and a layer of cushioning sound absorbing material is secured to the bottom surface of said dial adjacent said at least one opening whereby when said dial is rotated to occlude said at least one opening in said base member said sound absorbing material absorbs sound impinging thereon and when rotated to open said sound hole said cushioning and sound absorbing material impinges on the top surface of said base member.

* * * * *